US011958664B2

(12) United States Patent
Este

(10) Patent No.: US 11,958,664 B2
(45) Date of Patent: Apr. 16, 2024

(54) DISPENSING DEVICE AND ASSEMBLY FOR PACKAGING AND DISPENSING PRODUCT

(71) Applicants: Horus Pharma, Saint-Laurent-du-Var (FR); Santen SA, Geneva (CH)

(72) Inventor: Renzo Este, Nice (FR)

(73) Assignee: Horus Pharma (FR)

( * ) Notice: Subject to any disclaimer, the term of this patent is extended or adjusted under 35 U.S.C. 154(b) by 0 days.

(21) Appl. No.: 17/775,079

(22) PCT Filed: Nov. 4, 2020

(86) PCT No.: PCT/EP2020/080865
§ 371 (c)(1),
(2) Date: May 6, 2022

(87) PCT Pub. No.: WO2021/089575
PCT Pub. Date: May 14, 2021

(65) Prior Publication Data

US 2022/0388738 A1 Dec. 8, 2022

(30) Foreign Application Priority Data

Nov. 6, 2019 (EP) ..... 19306435

(51) Int. Cl.
*B65D 47/18* (2006.01)
*B65D 47/20* (2006.01)

(52) U.S. Cl.
CPC ..... *B65D 47/205* (2013.01); *B65D 47/18* (2013.01); *B65D 47/2056* (2013.01); *B65D 2547/06* (2013.01)

(58) Field of Classification Search
CPC . B05B 11/1032; B05B 11/007; B05B 11/028; B05B 11/0072; B65D 2547/06;
(Continued)

(56) References Cited

U.S. PATENT DOCUMENTS 2,188,802 A 1/1940 Lloyd
3,107,035 A 10/1963 Cholet
4,699,300 A * 10/1987 Blake ..... B65D 47/2081 222/481

(Continued)

FOREIGN PATENT DOCUMENTS

FR 2941682 A1 8/2010
WO 2015124844 A1 8/2015

OTHER PUBLICATIONS

Search Report for European Application No. 19306435.9 dated May 6, 2020. 2 pgs.

(Continued)

*Primary Examiner* — Charles P. Cheyney
(74) *Attorney, Agent, or Firm* — Lerner David LLP

(57) ABSTRACT

The invention relates to a dispensing device for dispensing a fluid product. The device includes a dispensing end; an attachment end; and a dispensing valve provided between the attachment end and the dispensing end and formed by a flexible member and a rigid member. The dispensing valve is actuatable between an open position in which a dispensing channel is formed between the flexible member and the rigid member, and a closed position in which the dispensing channel is closed. The dispensing valve includes a first valve portion and a second valve portion. The second valve portion is located closer to the dispensing end than the first valve portion. The dispensing valve is configured such that a greater biasing force is applied onto the rigid member by the flexible member in the first valve portion than in the second valve portion when the dispensing valve is in the closed position.

20 Claims, 10 Drawing Sheets

(58) Field of Classification Search
CPC ... B65D 47/205; B65D 47/18; B65D 47/2056
USPC ..... 222/207, 212, 213
See application file for complete search history.

(56) References Cited

U.S. PATENT DOCUMENTS 5,377,880 A * 1/1995 Moretti ..... B65D 83/0033 222/207
5,971,224 A * 10/1999 Garibaldi ..... B05B 11/1036 222/207
6,234,365 B1 * 5/2001 Bougamont ..... A61M 11/06 239/533.13
7,878,374 B2 * 2/2011 Decottignies ..... A45D 40/20 222/491
7,997,453 B1 * 8/2011 Gallegos ..... B65D 47/2087 222/207
9,004,317 B2 * 4/2015 Pozzi ..... B65D 51/1616 222/189.09
10,022,266 B2 * 7/2018 Claret ..... A61F 9/0026
2003/0062090 A1 * 4/2003 Secondo ..... B05B 11/007 137/853
2008/0118299 A1 * 5/2008 Py ..... B05B 11/0097
2010/0044395 A1 * 2/2010 Webb ..... A61L 2/26 222/562
2011/0163114 A1 * 7/2011 Webb ..... B65D 47/18 222/1
2011/0278323 A1 11/2011 Pozzi et al.
2013/0190704 A1 * 7/2013 Py ..... A61F 9/0008 604/298
2014/0124541 A1 * 5/2014 Mathiez ..... B05B 11/1085 222/207
2021/0070510 A1 * 3/2021 Pozzi ..... B65D 47/32

OTHER PUBLICATIONS

International Search Report for Application No. PCT/EP2020/080865 dated Mar. 11, 2021, pp. 1-3.

* cited by examiner

DISPENSING DEVICE AND ASSEMBLY FOR PACKAGING AND DISPENSING PRODUCT

CROSS-REFERENCE TO RELATED APPLICATIONS

The present application is a national phase entry under 35 U.S.C. § 371 of International Application No. PCT/EP2020/080865 filed Nov. 4, 2020, which claims priority from European Application No. 19306435.9 filed Nov. 6, 2019, all of which are hereby incorporated herein by reference.

FIELD OF THE INVENTION

The present invention relates to a dispensing device for dispensing a fluid product that is liquid, semi-fluid or suspension, in particular to such a device that is required to be kept in a clean and sterile condition. The invention also relates to an assembly comprising such a dispensing device.

BACKGROUND OF THE INVENTION

Various devices for packaging and dispensing a fluid product are known. Those devices may be used in the field of pharmaceutical products, in particular ophthalmology, cosmetic or food products. For example, WO 2015/124844 A1 discloses a device for packaging and dispensing a generally fluid product. The device disclosed therein is provided with a non-return valve designed to allow the product to be dispensed when pressure is applied to an actuatable portion of the device. The non-return valve returns to its original position once the pressure is released, thereby preventing outside air from entering into a dispensing channel.

The known device has been found useful to prevent bacteria entry from its dispensing opening to the dispensing channel. However, there is increasing demand for contamination-free dispensers.

The object of the invention is to provide a dispensing device that is free of bacteria or other substances, which could lead to contamination of the content of the dispensing device.

SUMMARY OF THE INVENTION

The object of the invention is achieved by a dispensing device as defined in appended claim 1 and the corresponding dependent claims.

Specifically, there is disclosed a dispensing device for dispensing a fluid product, comprising:

- a dispensing end through which the product is to be dispensed;
- an attachment end to be attached to a container containing the product; and
- a dispensing valve provided between the attachment end and the dispensing end and formed by a flexible member and a rigid member, the dispensing valve being configured to be actuatable between an open position in which a dispensing channel is formed between the flexible member and the rigid member to allow the product to flow toward the dispensing end, and a closed position in which the dispensing channel is closed;

wherein

- the dispensing valve comprises a first valve portion and a second valve portion, the second valve portion being located closer to the dispensing end than the first valve portion, the dispensing valve being configured such that a greater biasing force is applied onto the rigid member by the flexible member in the first valve portion than in the second valve portion when the dispensing valve is in the closed position.

The flexible member in the first valve portion may have a greater stiffness than in the second valve portion.

The flexible member and the rigid member may be configured to have a greater interference in the first valve portion than in the second valve portion.

The flexible member in the first valve portion may have a reinforcing member.

The flexible member in the first valve portion may have a greater thickness than in the second valve portion.

The flexible member may have at least partially a tapered shape tapering toward the dispensing end.

The flexible member in the first valve portion may be made of a material stiffer than a material of which the flexible member in the second valve portion is made.

The flexible member may have a surface facing the rigid member with greater rugosity in the first valve portion than in the second valve portion.

The rigid member may have a surface facing the flexible member with greater rugosity in the first valve portion than in the second valve portion.

The flexible member in the dispensing valve may comprise one or more grooves formed on a surface facing the rigid member.

The flexible member in the dispensing valve may comprise more than one groove on the surface facing the rigid member, a depth of a groove being greater than an adjacent groove situated closer to the dispensing end.

The rigid member in the dispensing valve may comprise one or more protrusions on a surface facing the flexible member.

The rigid member in the dispensing valve may comprise more than one protrusion, a protrusion protruding farther than an adjacent protrusion situated closer to the dispensing end.

The dispensing device may further comprise a dosing chamber provided between the dispensing valve and the attachment end and configured to store a measured amount of the product, the dosing chamber being defined between the rigid member and the flexible member outwardly spaced apart from the rigid member.

The dosing chamber may at least partially have a tapering shape toward the dispensing valve.

The flexible member defining the dosing chamber may comprise an inner tapered portion tapering toward the dispensing valve.

The rigid member defining the dosing chamber may comprise an outer tapered portion tapering toward the dispensing valve.

The dispensing channel and the dispensing end may be connected by a guide channel substantially extending at a right angle relative to the dispensing channel.

The guide channel may be defined by at least one groove or at least one opening formed on or in the rigid member.

The flexible member may be provided coaxially around the rigid member, the flexible member including an axial extension extending beyond the rigid member and a radial extension extending radially inwardly from the axial extension to define a dispensing opening at the dispensing end.

Moreover, there is disclosed an assembly for packaging and dispensing a fluid product, comprising:

a container configured to contain the product; and the dispensing device of any one of the preceding claims.

BRIEF DESCRIPTION OF THE DRAWINGS

Embodiments of the invention will be described in further detail with reference to the accompanying drawings, in which.

DETAILED DESCRIPTION OF THE EMBODIMENTS OF THE INVENTION

Figure 1:
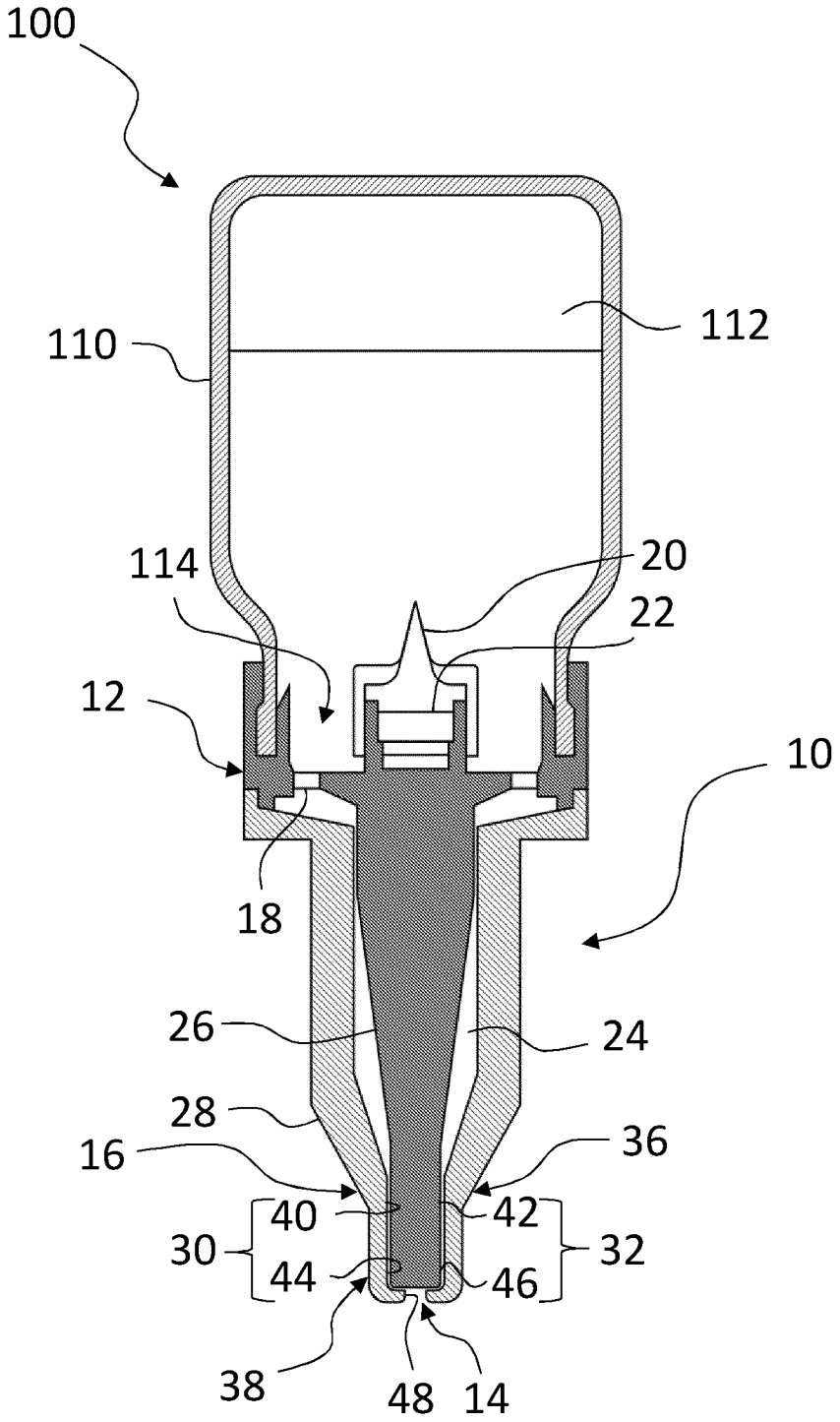
FIG. 1 is a longitudinal section view showing an assembly comprising a dispensing device.

FIG. 1 shows a dispensing and packaging assembly 100 by way of example, to which the present invention is applicable. The assembly 100 may be used for packaging and dispensing a fluid product. The fluid product may be, for example, in a liquid form, semi-liquid or suspension.

The assembly 100 may comprise a container 110 and a dispensing device 10. The container 110 defines a storing chamber 112 for containing the fluid product. The container 110 may be made of any suitable material for keeping the fluid product in a clean and sterile condition. For example, the container 110 may be made of glass or plastic. A plastic material used for the container 10 may include, but is not limited to, low density polyethylene, high density polyethylene, polypropylene, polyethylene terephthalate, polybutylene terephthalate, cyclic olefin polymer or cyclic olefin copolymer. The container 110 may define an opening 114 in fluid communication with the storing chamber 112.

The dispensing device 10 comprises an attachment end 12, a dispensing end 14 and a dispensing valve 16 provided between the attachment end 12 and the dispensing end 14.

The dispensing device 10 may be either directly or indirectly attached to the container 110 at the attachment end 12 by known means, including but not being limited to by fitting or screwing or by glue. A known sealing member may be provided between the attachment end 12 and the container 110 for preventing leakage of the fluid product and contamination of the fluid product contained in the storing chamber 110.

The dispensing device 10 may comprise a dose fill valve 18. The dose fill valve 18 may be supported by the attachment end 12 and configured as a normally closed check valve. The opening 114 of the container 110 is covered by a part of the attachment end 12 of the dispensing device 10 and the dose fill valve 18. The dose fill valve 18 is configured to allow the fluid product to flow from the container 110 to the dispensing device 10, but not in the opposite direction. Therefore, the fluid product contained in the storing chamber 112 can flow into the dispensing device 10 through the dose fill valve 18 when it is open, but the fluid product is prohibited from flowing backward, i.e. from the dispensing device 10 to the storing chamber 112.

The dispensing device 10 may also comprise an air fill valve 20 and a filter element 22. The air fill valve 20 and the filter element 22 may also be supported by the attachment end 12 of the dispensing device 10. The attachment end 12 may be provided with an air fill passage (not shown) to connect the storing chamber 112 and the atmosphere outside the assembly 100 to each other via the filter element 22 and the air fill valve 20. The air fill valve 20 is a normally closed valve and opens when the pressure inside the storing chamber 112 is reduced. With the aid of the filter element 22, when the air fill valve 20 is open, clean and fresh air can be introduced into the storing chamber 112 in order to compensate a pressure drop in the storing chamber 112 upon a dosage of the fluid product being dispensed.

The dispensing device 10 may also comprise a dosing chamber 24. The dosing chamber 24 is defined by an abutment part 26 and a deformable part 28. The abutment part 26 is made of a rigid material and extends between the attachment end 12 and the dispensing valve 16. The rigid material used for the abutment part 26 may include, but is not limited to, high density polyethylene or polypropylene. The deformable part 28 is made of a flexible material. The flexible material used for the deformable part 28 may include thermoplastic elastomer or silicon. The deformable part 28 may extend over and radially apart from the abutment part 26 to form an annular gap between an outer surface of the abutment part 26 and an inner surface of the deformable part 28. The dosing chamber 24 may define a predetermined volume corresponding to a dosage of the fluid product.

The dosing chamber 24 may have a tapering shape toward the dispensing end 14. Alternatively, the dosing chamber 24 may have a tapered shape over the entire length in an axial direction. The tapering shape of the dosing chamber 24 may be defined by an inner tapered portion formed on the deformable part 28 tapering toward the dispensing valve 16 and/or by an outer tapered portion formed on the abutment part 26 tapering toward the dispensing valve 16. The outer tapered portion of the abutment part 26 may face at least partially the inner tapered portion of the deformable part 28.

The dispensing valve 16 is formed by a valve member 30 and a valve seat 32. The valve member 30 is made of a flexible material and the valve seat 32 is made of a rigid material. The valve seat 32 may extend between the dosing chamber 24 and the dispensing end 14, in the case where the dispensing device 10 comprises the dosing chamber 24. The valve member 30 may have a generally tubular shape extending from the deformable part 28 in the direction toward the dispensing end 14.

Part of the valve member 30 may have a tapered shape tapering toward the dispensing end 14. Alternatively, the valve member 30 may have a tapered shape over the entire length along the valve seat 32 or in the axial direction.

The dispensing valve 16 is configured to be actuatable between an open position and a closed position. In the open position a dispensing channel 34 is formed between the valve member 30 and the valve seat 32 (see FIG. 3), thereby allowing the fluid product to flow toward the dispensing end 14. In the closed position the valve member 30 rests on the valve seat 32, thereby closing the dispensing channel 34.

The dispensing valve 16 is configured as a normally closed valve. The valve member 30 is configured to have an inner diameter (a diameter of the inner surface) smaller than a diameter (a diameter of the outer surface) of the valve seat 32. Thus, the valve member 30 is press-fitted onto the valve seat 32 in such a way that a biasing force is applied by the valve member 30 against the valve seat 32. The normally closed valve is thus formed. In the closed position the dispensing valve 16 reliably prevents bacteria penetration into the dispensing channel 34 or prevents the residue products from flowing inwardly of the dispensing device 10.

The dispensing valve 16 comprises a first valve portion 36 and a second valve portion 38. The first valve portion 36 is formed by a part of the valve member 30, or "first valve element 40", and a corresponding part of the valve seat 32, or "first valve seat 42". The second valve portion 38 is formed by the remaining part of the valve member 30, or "second valve element 44" and a corresponding part of the valve seat 32, or "second valve seat 46". The second valve portion 38 is located closer to the dispensing end 14 than the first valve portion 36.

The valve member 30 may be configured such that when the dispensing valve 16 is in the closed position, a greater biasing force is to be applied onto the first valve seat 42 by the first valve element 40 than a biasing force applied onto the second valve seat 46 by the second valve element 44. As a result, the first valve element 40 exhibits stronger resistance than the second valve element 44 against a force acting in the direction away from the corresponding valve seat 42 or 46. In other words, the first valve element 40 has a greater stiffness than the second valve element 44.

The dispensing end 14 may define an opening 48 or a channel, through which the fluid product is to be dispensed when the assembly 100 is in operation.

Figure 3:
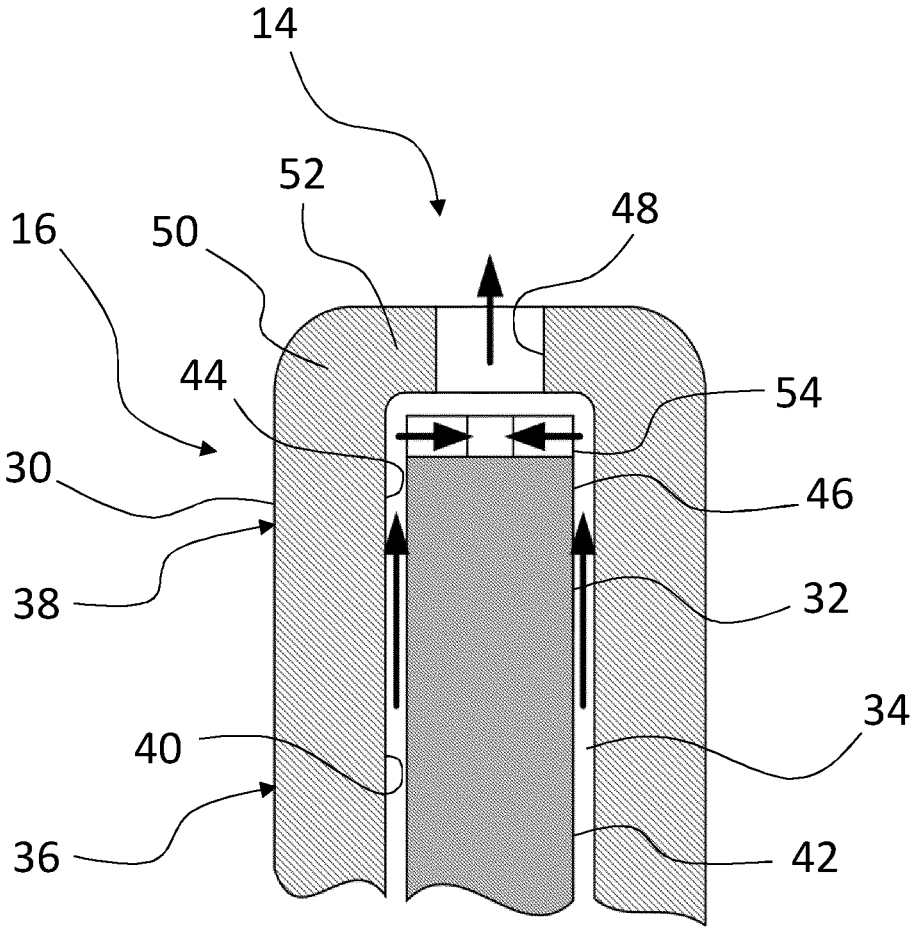
FIG. 3 is an enlarged view showing part of the assembly of FIG. 1 around a dispensing end.

As shown in FIG. 3, the dispensing device 10 (see FIG. 1) may comprise an axial extension 50 extending from the valve member 30 extending beyond the valve seat 32 and a radial extension 52 extending radially inwardly from the axial extension 50 to define the opening 48.

Figure 2:
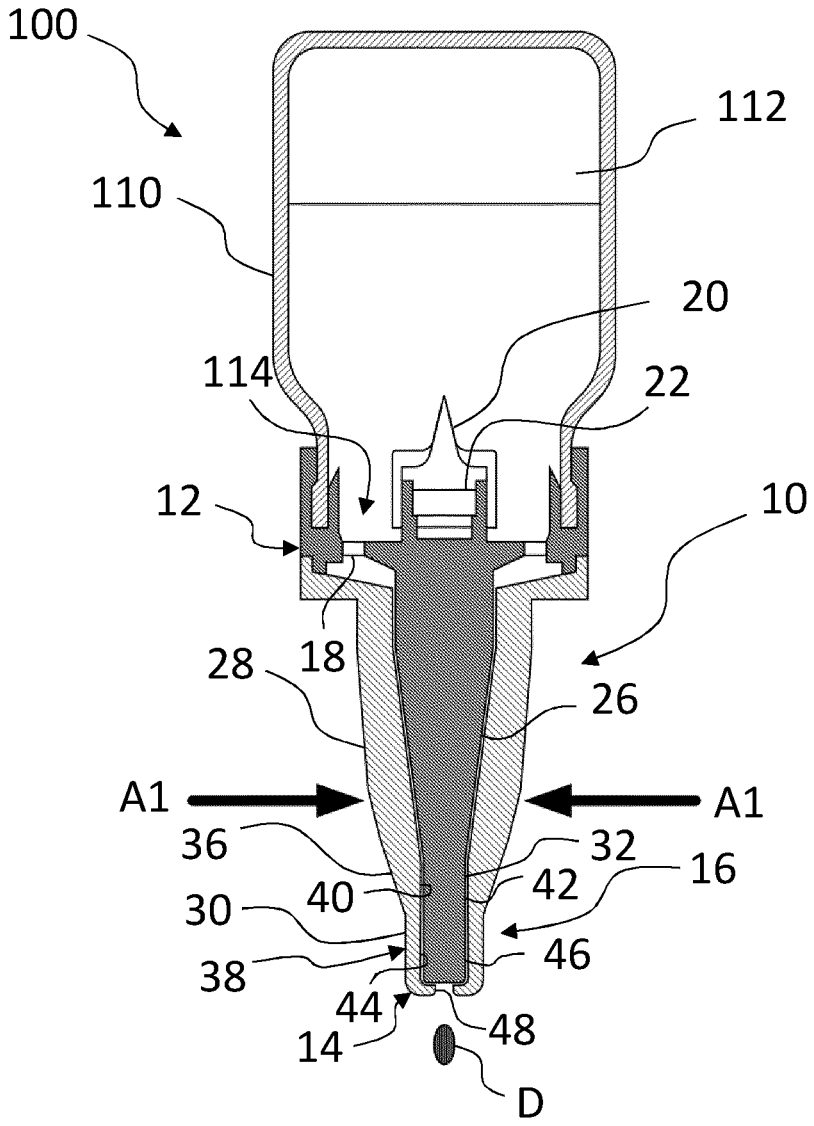
FIG. 2 is a longitudinal section view showing the assembly of FIG. 1 when a dosing chamber is compressed to dispense a dosage of the fluid product.

In operation, the deformable part 28 is pressed inwardly as shown by arrows A1 in FIG. 2 to compress the dosing chamber 24 (see FIG. 1). With the dose fill valve 18 preventing a backflow of the fluid product to the storing chamber 112, the fluid product under pressure forcibly flows into the dispensing valve 16 where the fluid product displaces the valve member 30 apart from the valve seat 32 against the biasing force, thereby forming the dispensing channel 34 between the valve member 30 and the valve seat 32. When the deformable part 28 is pressed to the full extent, or when the deformable part 28 comes in contact with the abutment part 26, the measured amount of the fluid product that have been contained in the dosing chamber 24 is expelled from the dispensing end 14 through the opening 48, e.g. in the form of a drop D.

Upon completion of the dispensing operation and release of the pressure applied onto the deformable part 28, the dispensing valve 16 returns to the closed position where the valve member 30 rests on the valve seat 32 to close the dispensing channel 34.

Since the first valve portion 36 is subjected to a greater biasing force than the second valve portion 38 in the closed position, the first valve portion 36 returns to the closed position quicker than the second valve portion 38. As the first valve portion 36 moves back to the original position, the first valve portion 36 pushes any residue product out of the first valve portion 36 and into the second valve portion 38. As the second valve portion 38 subsequently returns to the closed position, the residue product is pushed out of the dispensing device 10, leaving no or very little residue product in the dispensing valve 16. At the same time any bacteria or undesired objects that have existed in the dispensing channel 34 are as well discharged from the dispensing device 10.

In this way, the dispensing device 10 can be protected from any undesired object, which could otherwise enter the dispensing valve 16 or flowing backward to the first valve portion 36 from the second valve portion 38. This is particularly advantageous in the field of ophthalmology in which bacteria contamination in the fluid product could possibly cause a significant consequence to the eyes of the user.

Referring to FIG. 3, the dispensing valve 16 may be configured such that the fluid product flows from the dispensing channel 34 to the opening 48 via a guide channel 54. The guide channel 54 connects the dispensing channel 34 and the dispensing end 14 to each other and extends substantially at a right angle relative to the dispensing channel 34. According to this configuration, the fluid product changes the flowing direction and thus reduces its speed, thereby avoiding a spurt in the eye and ensuring that a drop is formed at the dispensing end 14.

Figure 4:
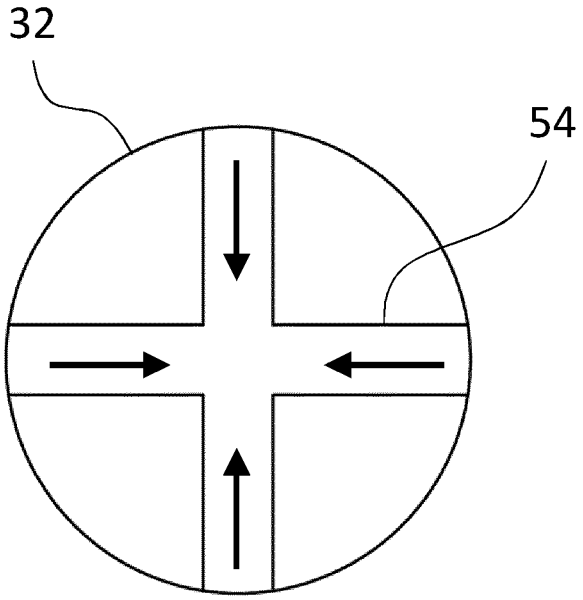
FIG. 4 shows guide channels formed on a valve seat.

Furthermore, with such a guide channel 54 provided between the opening 48 and the dispensing channel 34, the opening 48 has a smaller diameter than that of the dispensing channel 34. This facilitates release of the drop from the dispensing device 10. The guide channel 54 may be defined by one or more groove formed on the tip of the valve seat 32 (see FIGS. 3 and 4). The groove(s) may be formed to extend radially and meet at a center corresponding to the position of the opening 48. Alternatively, the valve seat 32 may be formed with a radial channel (not shown) to define the guide channel 54. Even without the radial groove(s) or the radial channel, the guide channel 54 may also be formed between the radial extension 52 and the tip of the valve seat 32.

As described above, when the dispensing valve 16 is in the closed position, a greater biasing force is applied onto the first valve seat 42 by the first valve element 40 than a biasing force applied onto the second valve seat 46 by the second valve element 44. This configuration may be implemented by various ways.

For example, as shown in FIG. 1, the flexible member forming the deformable part 28 and the valve member 30 may be configured to have a hollow truncated conical shape. The flexible member may also have a thickness that gradually decreases or increases toward the dispensing end 14.

Alternatively or additionally, the dispensing valve 16 may be configured such that the thickness of the first valve element 40 is greater than that of the second valve member 44. The thickness of the valve member 30 is defined by the size of the valve member 30 measured in a direction tangential to a contact surface (or a direction perpendicular to a contact surface in the case of a flat contact surface) between the valve member 30 and the valve seat 32.

As an alternative or additional configuration, the dispensing valve 16 may be configured to have difference amounts of interference between the first valve portion 36 and the second valve portion 38. Specifically, the first valve portion 36 may be ensured to have a greater interference than the second valve portion 38. For example, an interference may be in the range between 0.15 to 0.30 mm in the first valve portion 36, while an interference may be in the range of 0.05 to 0.20 mm in the second valve portion 38. According to this configuration, the first valve portion 36 is subjected to tighter fit and returns to the closed position more quickly than the second valve portion 38, thereby keeping the dispensing device 10 in a clean and sterile condition.

As another alternative or additional configuration, the dispensing valve 16 may be configured such that the first valve element 40 is made of a material stiffer than a material of which the second valve element 44 is made. This configuration also contributes to sequential closing of the dispensing channel 34 by the dispensing valve 16.

Figure 5:
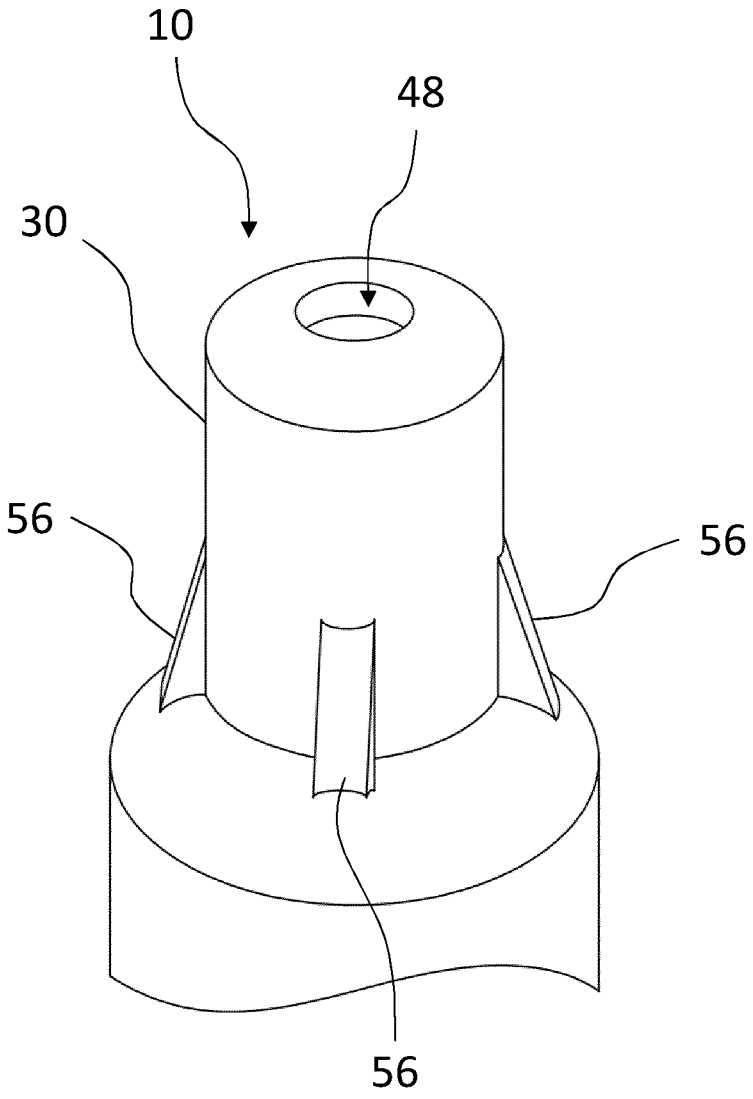
FIG. 5 shows a valve member provided with reinforcing members.

FIG. 5 shows another possible configuration in which the valve member 30 is provided with one or more reinforcing member 56 in the first valve portion 36. The reinforcing members 56 respectively extend spaced apart from each other and radially outwardly from the valve member 30. Such a reinforcing member 56 contributes an increased rigidity of the first valve portion 36, compared to the second valve portion 38. The reinforcing members 54 may have the identical shape to each other or a different shape from one another, corresponding to the desired stiffness.

Figure 6:
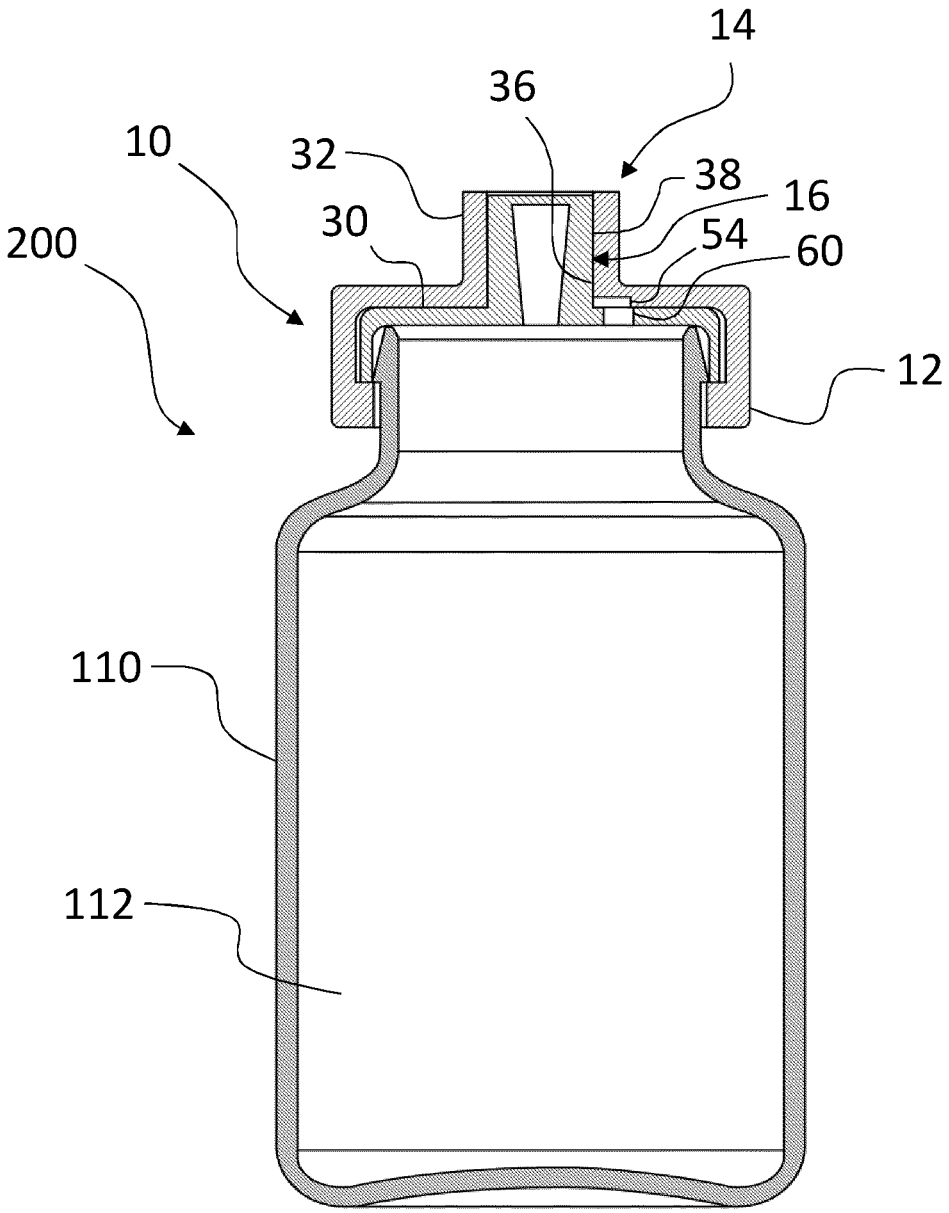
FIG. 6 is a longitudinal section view showing another assembly comprising a dispensing device.
Figure 7:
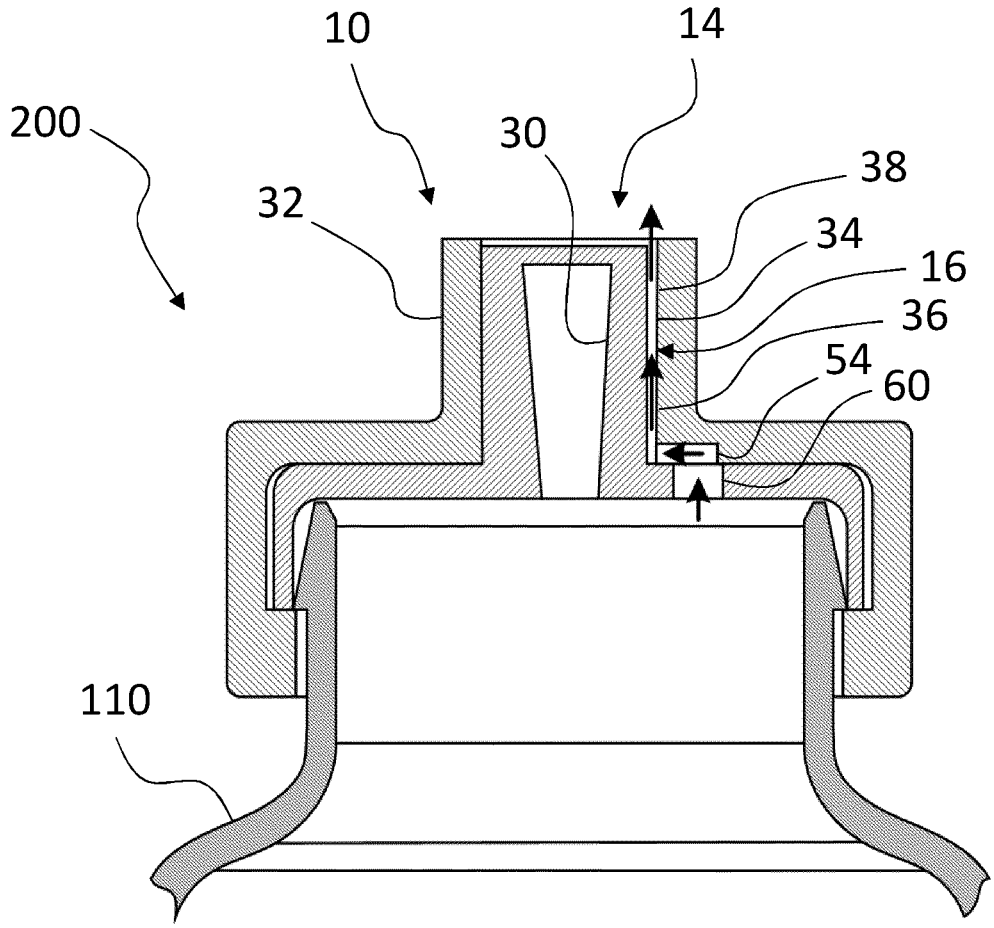
FIG. 7 is an enlarged view showing part of the assembly of FIG. 6 around a dispensing end of the dispensing device.

FIGS. 6 and 7 show another exemplary assembly 200 for packaging and dispensing a fluid product. The assembly 200 comprises a container 110 and a dispensing device 10. The assembly 200 differs from the assembly 100 shown in FIG. 1 in that the dispensing device 10 does not comprise the dosing chamber 24 and a flexible member forming the valve member 30 is arranged radially inside the rigid member forming the valve seat 32.

In this embodiment, the container 110 is made of a flexible material and thus fluid pressure inside the container 110 is subject to change when a compressive force is applied onto the container 110. When the storing chamber 112 of the container 110 is compressed, the fluid product contained in the container 110 is forcibly directed to the dispensing valve 16 to open the dispensing channel 34.

As shown in arrows in FIG. 7, the fluid product flows through a through hole 60 formed in a base plate into a guide channel 54. The fluid product under increased pressure displaces the valve member 30 away from the valve seat 32 to form a dispensing channel 34. The fluid product is introduced into the dispensing channel 34 and discharged at dispensing end 14, also as shown in arrows in FIG. 7.

In a similar manner as the above explained embodiment, the dispensing valve 16 of this embodiment may be configured such that a greater biasing force is applied in the first valve portion 36 than in the second valve portion 38 when the dispensing valve 16 is in the closed position.

Therefore, upon release of the pressure that has been applied onto the container 110, the first valve portion 36 moves back to the original position, the first valve portion 36 pushes any residue product out of the first valve portion 36 and into the second valve portion 38. As the second valve portion 38 subsequently returns to the closed position, the residue product is pushed out of the dispensing device 10, leaving no or very little residue product in the dispensing valve 16. At the same time any bacteria or undesired objects that have existed in the dispensing channel 34 are as well discharged from the dispensing device 10.

In this way, the dispensing device 10 can be protected from any undesired object, which could otherwise enter the dispensing valve 16 or flowing backward to the first valve portion 36 from the second valve portion 38.

Figure 8:
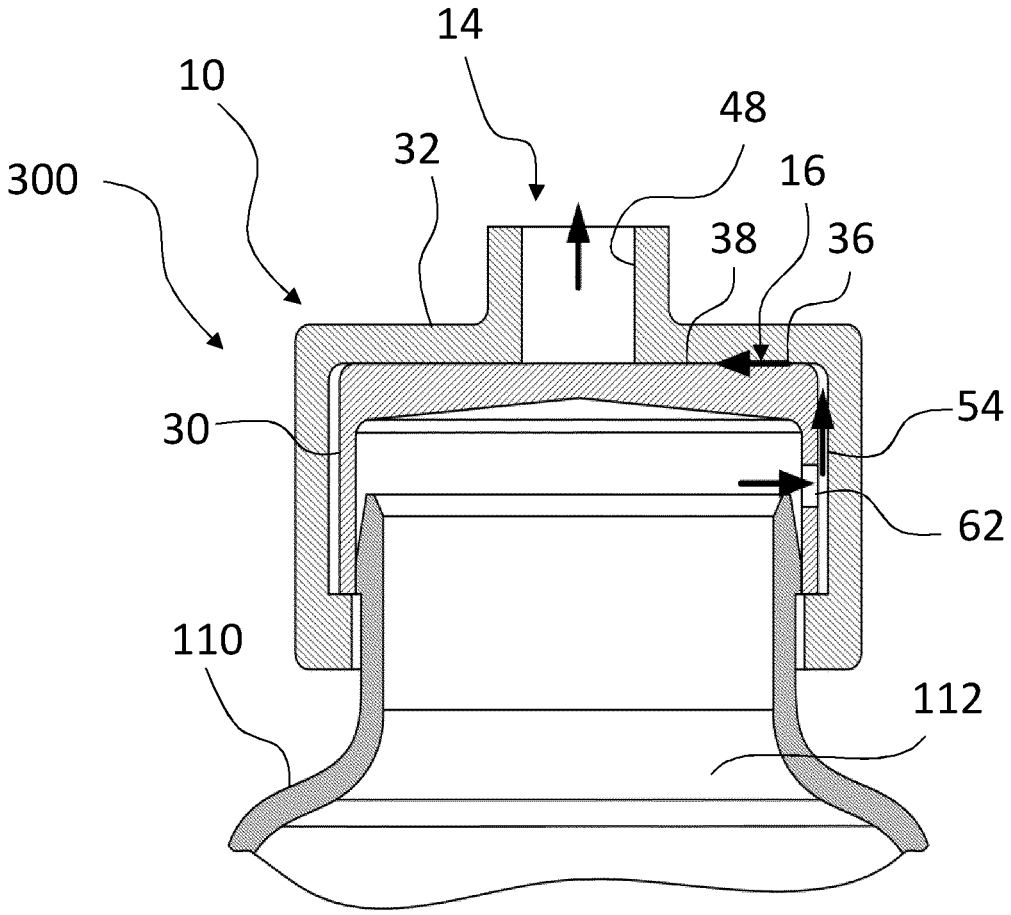
FIG. 8 is an enlarged view showing part of another assembly around a dispensing end of a dispensing device.

FIG. 8 shows another exemplary assembly 300 for packaging and dispensing a fluid product. The assembly 300 according to this embodiment differs from the assembly 200 illustrated in FIGS. 6 and 7 in that the dispensing channel 34 is to form in a direction perpendicular to the opening 48 at the dispensing end 14 or in the radial direction.

According to this embodiment, the storing chamber 112 of the container 110 is compressed and the fluid product is forced to flow into the guide channel 54 via a through hole 62 formed in the flexible member forming the valve member 30. The guide channel 54 extends perpendicular to the dispensing channel 34 formed between the valve member 30 and the valve seat 32. In a similar manner as the above explained embodiments, the pressure of the fluid product is sufficient to displace the valve member 30 away from the valve seat 32 to form the dispensing channel 34.

In a similar manner as the above explained embodiment, the dispensing valve 16 of this embodiment may be configured such that a greater biasing force is applied in the first valve portion than in the second valve portion when the dispensing valve 16 is in the closed position.

Therefore, upon release of the pressure that has been applied onto the container 110, the first valve portion 36 moves back to the original position, the first valve portion 36 pushes any residue product out of the first valve portion 36 and into the second valve portion 38. As the second valve portion 38 subsequently returns to the closed position, the residue product is pushed out of the dispensing device 10, leaving no or very little residue product in the dispensing valve 16. At the same time any bacteria or undesired objects that have existed in the dispensing channel 34 are as well discharged from the dispensing device 10.

In this way, the dispensing device 10 can be protected from any undesired object, which could otherwise enter the dispensing valve 16 or flowing backward to the first valve portion 36 from the second valve portion 38.

As the stiffness of a valve member made of a flexible material increases, the more pressure is required to open the normally closed valve to form a dispensing channel between the valve member and a corresponding valve seat. It is relevant to dispensing devices to find a proper balance between tight sealing of the dispensing device and easy dispensing operation.

Figure 9:
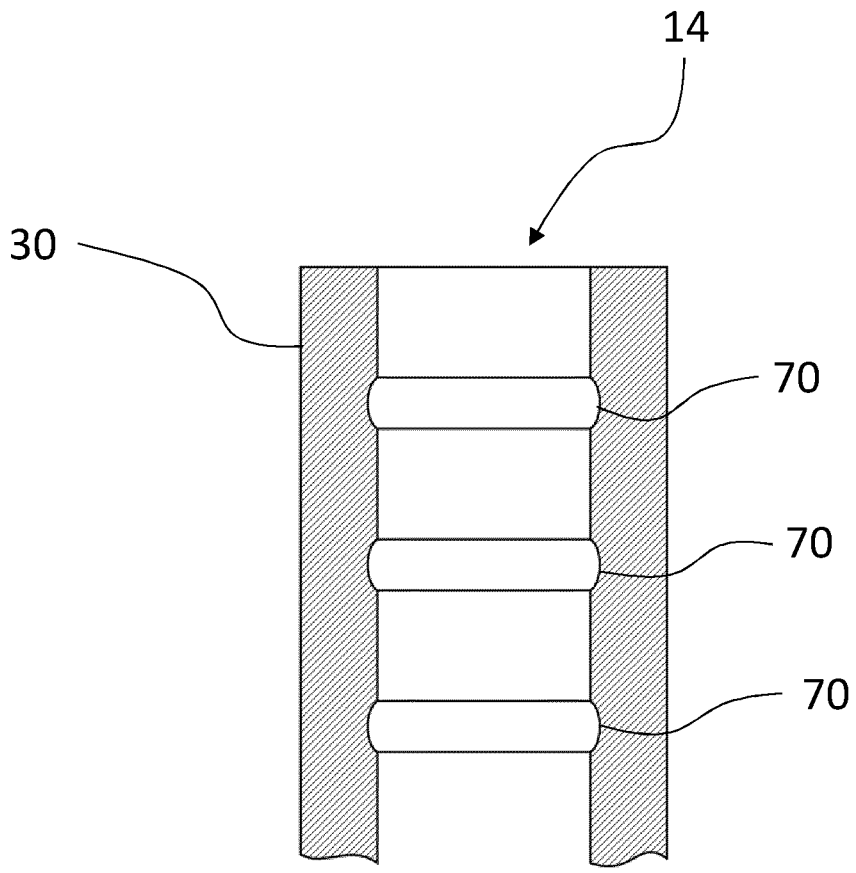
FIG. 9 is a schematic sectional view showing a valve member provided with annular grooves.

In order to reduce required force to lift the valve member from the valve seat, the valve member 30 may be provided with one or more grooves, e.g. annular groove(s) 70 formed on a surface facing the valve seat 32. As shown in FIG. 9, a plurality annular grooves 70 may be provided in the case where the valve member 30 is in the tubular form. If the surface of the valve member 30 extends parallel with the valve seat 32 (e.g. see FIG. 8), one or more elongated grooves may be formed on the valve member 30. The depth of such a groove may be 0.10 mm at most. The grooves 70 of depth up to 0.10 mm assist the valve member 30 move away from the valve seat 32, and at the same time avoiding residue product from accumulating in the grooves.

Alternatively, the grooves 70 may have a depth up to 40 mm. In this case, the valve member 30 may not be in contact with the valve seat 32 in the portion where the grooves 70 are formed.

In the case where more than one groove 70 are provided, a depth of a groove may be formed greater than an adjacent groove situated closer to the dispensing end 14, thereby reducing force that is required to open the first valve portion 36.

Further, thanks to one or more groove 70, the fluid product is distributed evenly in the circumferential direction, i.e. around the valve seat 32, assisting the dispensing valve 16 to move to the open position.

Figure 10:
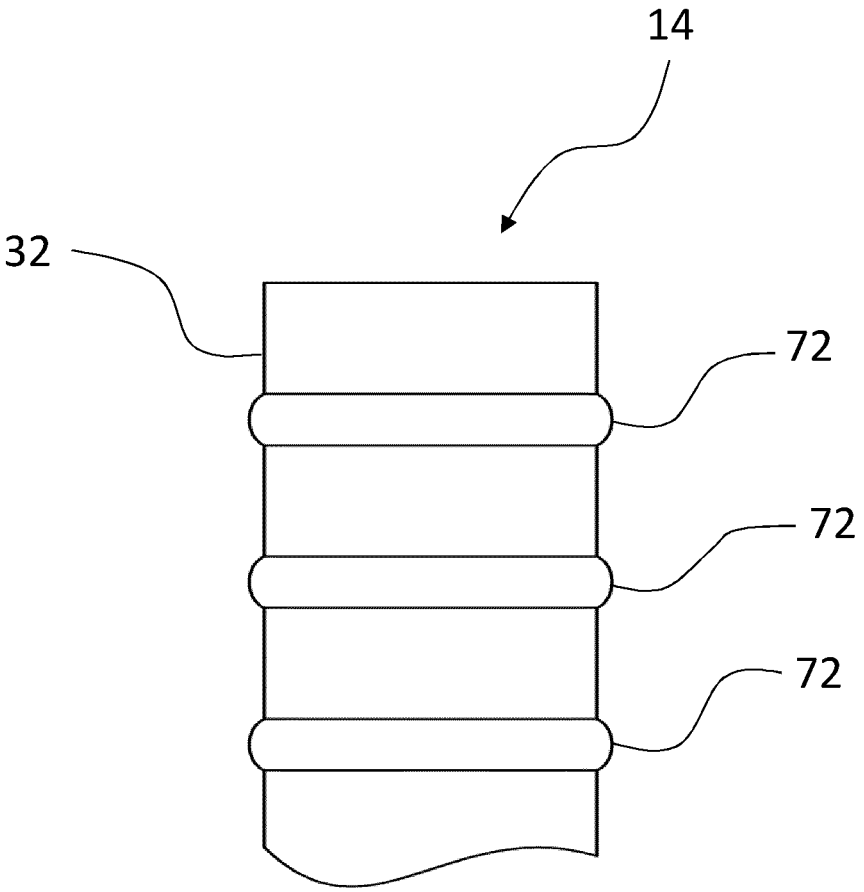
FIG. 10 is a schematic view a valve seat provided with protrusions.

Instead of or in addition to one or more grooves on the valve member 30, one or more protrusions 72 may be formed on a surface of the valve seat 32 facing the valve member 30. FIG. 10 shows the embodiment where the valve seat 32 is provided with more than one protrusion 72. If more than one protrusion 72 are provided, a protrusion may protrude farther than an adjacent protrusion situated closer to the dispensing end.

Those groove(s) and/or protrusion(s) may contribute to adjusting tightness between the valve member 30 and the valve seat 32. Therefore, less force is required to move the valve member 30 away from the valve seat 32, thereby facilitating formation of the dispensing channel 34.

Although not illustrated, according to an embodiment, the surface of the valve member 30 has a surface facing the valve seat 32 with greater rugosity in the first valve element 40 than in the second valve element 44. The rugosity may be in the range between 3 to 5 microns in the first valve portion 36. The rugosity in the second valve portion 38 may be in the range between 0.3 to 3 microns to avoid bacteria from sticking to the second valve portion 38. In contrast, the valve seat 32 may have a smooth surface.

Alternatively, the valve seat 32 may have different levels of rugosity on a surface facing the valve member 30 between the first valve portion 36 and the second valve portion 38. Specifically, the valve seat 32 may have greater rugosity in the first valve portion 36 than in the second valve portion 38. In this case, the valve member 30 may have a smooth surface.

Thanks to pair of the rough surface and the smooth surface between the valve seat 32 and the valve member 30, less force is required to move the valve member 30 away from the valve seat 32, thereby facilitating formation of the dispensing channel 34.

In the case where the valve member 30 and/or the valve seat 32 have a predetermined level of rugosity on its surface, the rough surface of the valve member 30 and/or the valve seat 32 may alternate with a smooth part.

Furthermore, the dosing chamber 24 may have a tapered shape toward the dispensing valve 16, as shown in FIG. 1. Due to the dosing chamber 24 having a tapered shape, when the fluid product contained in the dosing chamber 24 flows into the dispensing valve 16, the fluid under pressure exerts a pushing force radially outwardly, making it easier for the valve member 30 to move away from the valve seat 32. Therefore, the dispensing channel 34 can be formed reliably and easily.

The invention claimed is:

1. A dispensing device for dispensing a fluid product, comprising:

a dispensing end through which the product is to be dispensed;

an attachment end to be attached to a container containing the product; and a dispensing valve provided between the attachment end and the dispensing end and formed by a flexible member and a rigid member, the dispensing valve being configured to be actuatable between an open position in which a dispensing channel is formed between the flexible member and the rigid member to allow the product to flow toward the dispensing end, and a closed position in which the dispensing channel is closed, wherein the dispensing valve comprises a first valve portion and a second valve portion formed by the flexible member and a first valve seat and a second valve seat formed by the rigid member, the second valve portion being located closer to the dispensing end than the first valve portion, the dispensing valve being configured such that the first valve portion directly rests on the first valve seat and the second valve portion directly rests on the second valve seat when the dispensing valve is in the closed position and that a greater biasing force is applied by the first valve portion onto the first valve seat than a biasing force applied by the second valve portion onto the second valve seat when the dispensing valve is in the closed position, wherein the flexible member is provided coaxially around the rigid member, the flexible member including an axial extension extending axially farther from the attachment end than a farthest tip of the rigid member, and a radial extension extending radially inwardly from the axial extension to define a dispensing opening at the dispensing end, the dispensing opening being situated axially farther from the attachment end than the farthest tip of the rigid member, wherein the dispensing channel and the dispensing opening are connected by a guide channel defined between the radial extension and the farthest tip of the rigid member, the guide channel being in fluid communication with the dispensing opening irrespective of whether the dispensing valve is in the open position or in the closed position.

2. The device according to claim 1, wherein the flexible member in the first valve portion has a greater stiffness than in the second valve portion.

3. The device according to claim 1, wherein the flexible member and the rigid member are configured to have a greater interference in the first valve portion than in the second valve portion.

4. The device according to claim 1, wherein the flexible member in the first valve portion has a reinforcing member.

5. The device according to claim 1, wherein the flexible member in the first valve portion has a greater thickness than in the second valve portion.

6. The device according to claim 1, wherein the flexible member has at least partially a tapered shape tapering toward the dispensing end.

7. The device according to claim 1, wherein the flexible member in the first valve portion is made of a material stiffer than a material of which the flexible member in the second valve portion is made.

8. The device according to claim 1, wherein the flexible member has a surface facing the rigid member with greater rugosity in the first valve portion than in the second valve portion.

9. The device according to claim 1, wherein the rigid member has a surface facing the flexible member with greater rugosity in the first valve seat than in the second valve seat.

10. The device according to claim 1, wherein the flexible member in the dispensing valve comprises one or more grooves formed on a surface facing the rigid member.

11. The device according to claim 10, wherein the flexible member in the dispensing valve comprises more than one groove on the surface facing the rigid member, a depth of a groove being greater than an adjacent groove situated closer to the dispensing end.

12. The device according to claim 1, wherein the rigid member in the dispensing valve comprises one or more protrusions on a surface facing the flexible member.

13. The device according to claim 12, wherein the rigid member in the dispensing valve comprises more than one protrusion, a protrusion protruding farther than an adjacent protrusion situated closer to the dispensing end.

14. The device according to claim 1, further comprising a dosing chamber provided between the dispensing valve and the attachment end and configured to store a measured amount of the product, the dosing chamber being defined between the rigid member and the flexible member outwardly spaced apart from the rigid member.

15. The device according to claim 14, wherein the dosing chamber at least partially has a tapering shape toward the dispensing valve.

16. The device according to claim 15, wherein the flexible member defining the dosing chamber comprises an inner tapered portion tapering toward the dispensing valve.

17. The device according to claim 14, wherein the rigid member defining the dosing chamber comprises an outer tapered portion tapering toward the dispensing valve.

18. The device according to claim 1, wherein the guide channel substantially extends at a right angle relative to the dispensing channel.

19. The device according to claim 18, wherein the guide channel is defined by at least one groove or at least one opening formed on or in the rigid member.

20. An assembly for packaging and dispensing a fluid product, comprising:

a container configured to contain the product; and a dispensing device for dispensing the product, wherein the dispensing device comprises:

a dispensing end through which the product is to be dispensed;

an attachment end attached to the container containing the product; and a dispensing valve provided between the attachment end and the dispensing end and formed by a flexible member and a rigid member, the dispensing valve being configured to be actuatable between an open position in which a dispensing channel is formed between the flexible member and the rigid member to allow the product to flow toward the dispensing end, and a closed position in which the dispensing channel is closed, and wherein the dispensing valve comprises a first valve portion and a second valve portion formed by the flexible member and a first valve seat and a second valve seat formed by the rigid member, the second valve portion being located closer to the dispensing end than the first valve portion, the dispensing valve being configured such that the first valve portion directly rests on the first valve seat and the second valve portion directly rests on the second valve seat when the dispensing valve is in the closed position and that a greater biasing force is applied by the first valve portion onto the first valve seat than a biasing force applied by the second valve portion onto the second valve seat when the dispensing valve is in the closed position, and wherein the flexible member is provided coaxially around the rigid member, the flexible member including an axial extension extending axially farther from the attachment end than a farthest tip of the rigid member, and a radial extension extending radially inwardly from the axial extension to define a dispensing opening at the dispensing end, the dispensing opening being situated axially farther from the attachment end than the farthest tip of the rigid member, wherein the dispensing channel and the dispensing opening are connected by a guide channel defined between the radial extension and the farthest tip of the rigid member, the guide channel being in fluid communication with the dispensing opening irrespective of whether the dispensing valve is in the open position or in the closed position.

* * * * *